United States Patent [19]

Strehler et al.

[11] 4,030,314

[45] June 21, 1977

[54] METHOD AND APPARATUS FOR PRESERVING BIOLOGICAL MATERIALS

[76] Inventors: John Frederick Strehler, 1597 Prestwick, Grosse Pointe Woods, Mich. 48236; John Joseph Mikoliczeak, 32261 Arlington Drive, Birmingham, Mich. 48009; Kirk Robert Strehler, 22462 Ardmore Park, St. Clair Shores, Mich. 48081

[22] Filed: Apr. 7, 1976

[21] Appl. No.: 674,504

[52] U.S. Cl. ..... 62/65; 62/78; 62/514 R; 128/1 R; 195/1.8

[51] Int. Cl.[2] ..... F25D 13/04

[58] Field of Search ..... 165/2, 30, 61; 62/62, 62/65, 78, 223, 514 R; 195/1.7, 1.8; 128/1 R

[56] References Cited

UNITED STATES PATENTS

| | | | |
|---|---|---|---|
| 2,655,007 | 10/1953 | Lazar | 62/64 |
| 3,092,974 | 6/1963 | Haumann et al. | 62/64 |
| 3,940,943 | 3/1976 | Sikes et al. | 62/65 |

*Primary Examiner*—Ronald C. Capossela
*Attorney, Agent, or Firm*—Frank John Catalano

[57] ABSTRACT

Preservation of biological materials is accomplished by apparatus and a process with and by which the material is cooled at a substantially linear rate to approximately freezing temperature, changed from the liquid to the solid phase at relatively constant temperature, and cooled at a substantially linear rate to an end temperature. The environment surrounding the material is rapidly chilled when the material reaches freezing temperature or a temperature minimally warmer than freezing temperature in the liquid phase to initiate phase change with minimal risk of super cooling the material, and is then warmed to freezing temperature or a temperature minimally cooler than freezing temperature to minimize temperature drop in the material upon completion of phase change. The apparatus contemplates, among other things, preselection of cooling rates, duration of phase change, and the end temperature.

16 Claims, 6 Drawing Figures

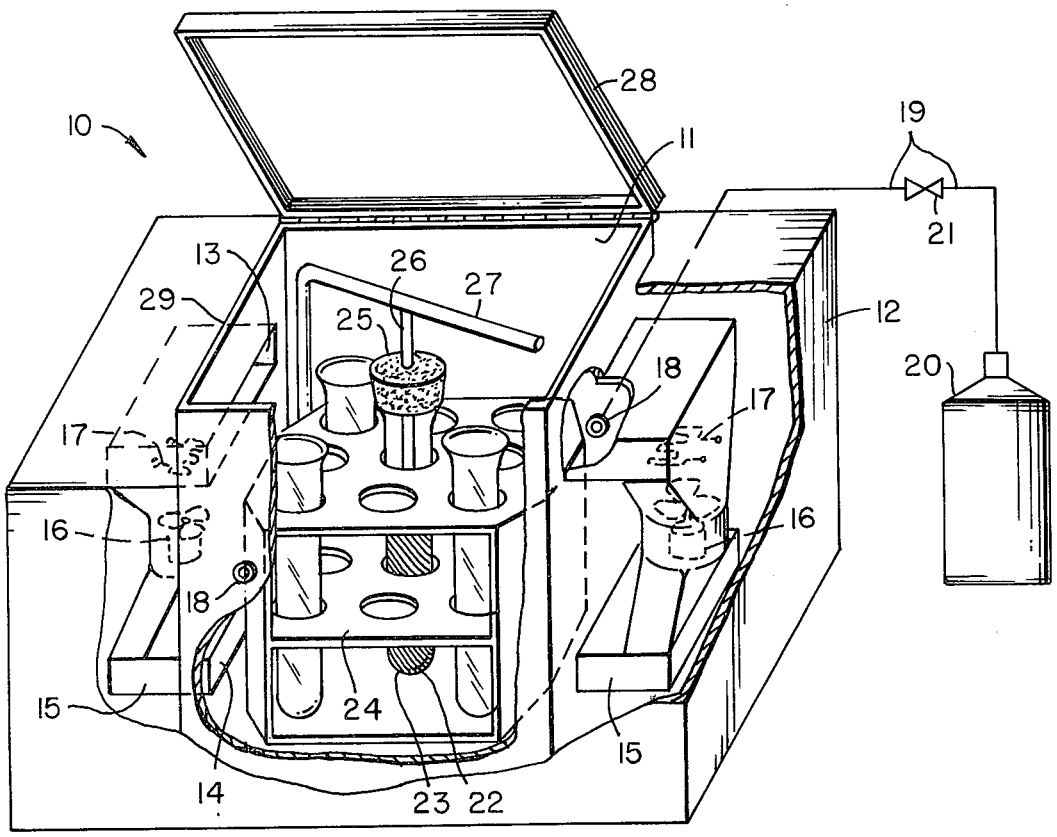
FIG.1
FIG.2
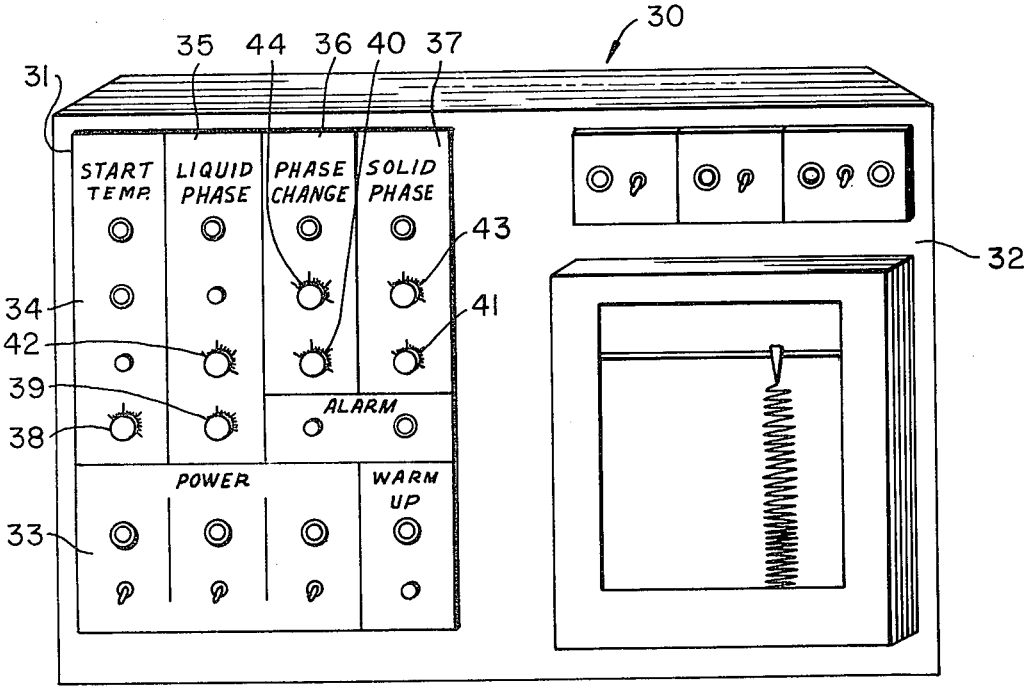

METHOD AND APPARATUS FOR PRESERVING BIOLOGICAL MATERIALS

BACKGROUND OF THE INVENTION

This invention relates generally to biology and more particularly concerns the process of preserving biological materials by freezing.

Interest in cryobiological research has been recorded for approximately 200 years. Since 1949, when glycerol was introduced as a freeze-thaw protective agent, research in this field has experienced a significant upsurge.

This upsurge in activity is largely due to the improved success-failure ratios afforded by the use of glycerol.

One theory advanced to explain the success experienced with glycerol is that increased salt concentration during the freezing process causes damage to the biological material, and that glycerol acts as a salt buffer. A parallel theory, however, is that ice crystals formed during the freezing process damage the biological material by compressing, puncturing or disarranging it, and the possibility of such mechanical ice damage increases with the size of the crystals formed. Glycerol is therefore considered effective against such damage because it modifies intra and extra cellular ice crystallization in the biological material.

Considering this problem of mechanical damage caused by ice crystallization from a slightly different perspective, not only temperature but also the duration of the freezing cycle bears significance. For example, it is believed that a fast freezing cycle results in the formation of smaller ice crystals and therefore minimizes damage. On the other hand, it is also proposed that a slow freezing cycle is conducive to greater dehydration of the biological material which in turn minimizes damage. While these theories appear to be in conflict, each may be applicable depending on the particular biological material involved.

Many other factors have been found to related to the success-failure ratio of the freezing process. Among them is the phenomenon of temperature shock, also called cold or thermal shock, in which rapid temperature change causes damage in different biological materials due to alteration of various physiological functions in the materials. Also, minimum mass and maximum surface area of the biological material to be frozen are found to enhance the degree of temperature control.

The foregoing discussion is given to illustrate the factors related to the success of the freezing process. It is seen that regardless of the biological material being frozen, or of the cryobiological theory applied, the success of the freezing process will be largely dependent on the accurate control of the temperature of the biological material and the rate of the change of that temperature throughout the freezing process. Therefore, in order to understand the problems with which the present invention deals, the freezing process itself should be at least briefly examined.

The freezing cycle may be considered in three separate stages. The first stage, during which the biological material is in the liquid phase, extends from some initial temperature, perhaps ambient room temperature, to the freezing temperature of the biological material. This initial temperature is merely a point of reference at which the cycle may be considered to begin and is not critical. The rate of cooling and the final temperature of this stage are critical, however. Rapid changes in temperature may cause damage to the biological material, as suggested in the temperature shock theory. Also, a substantially linear approach to the freezing temperature assures maximum temperature control at that point. Reaching the exact freezing temperature or a temperature minimally above it as the terminal point of the first stage is critical because, if the second, or phase change, stage is initiated at any temperature appreciably higher than the freezing temperature, rapid temperature drop will occur, possibly causing temperature shock. On the other hand, if the first stage is not concluded at freezing temperature, the delay will cause supercooling of the biological material and a rapid return to freezing temperature when phase change is initiated, also possibly causing temperature shock.

The second stage of the freezing process preferably takes place at a constant biological material temperature and extends from the point at which the biological material reaches freezing temperature to the point at which the latent heat of fusion has been removed. As has been pointed out, the completion of the first and initiation of the second stage at or slightly above the freezing point of the biological material is essential to avoid either supercooling of or temperature shock to the material. Moreover, it is during this second phase that crystallization occurs. Therefore, it is necessary that the rate at which the latent heat of fusion is removed be accurately controlled, so that damage resulting from too slow or too rapid crystallization can be avoided. Furthermore, it is essential that the second stage be concluded at the point at which the latent heat of fusion is removed because, since extremely low chamber temperatures are required in this stage, continuance beyond this point may also cause temperature shock to the biological material.

The third and final stage of the freezing process extends from the point at which the latent heat of fusion has been removed to a preselected final temperature at which the biological material is to be stored. Again it is necessary, to avoid the damage of temperature shock, that there be a substantially linear approach to this final temperature.

Various methods and apparata have been devised to accomplish the control of temperature and rate of change of temperature during the freezing process. Among these is the temperature differential method, according to which differential thermocouples sense the temperature difference between a dummy sample and the cooling chamber. If this difference drops below a preselected value, more coolant is demanded by the system until the differential reaches the preselected value. This method is workable, but has several shortcomings. Maintenance of the same temperature difference throughout the freezing process results in different cooling rates in each of the process stages. Increasing or decreasing the preselected difference to achieve desirable results in one of the stages may well produce undesireable results in either or both of the other stages. Also, since temperature difference rather than the temperature of the dummy sample is controlling, supercooling will occur at the end of the first stage. Furthermore, since the size and geometry of the sample vary its cooling rate, preselection of the most appropriate temperature difference for a given process application can cause difficulty.

Another method of controlling the freezing process is known as the cam type program, according to which the temperature of the biological material is forced to follow a preselected temperature curve through use of some type of comparator circuit. This method provides more stage to stage flexibility than the temperature differential method, but introduces other problems. For example, any change in sample size, geometry, material, protective additive, and so on, will require a different preselected temperature curve. This problem is compounded by the fact that, since introduction of coolant to the sample is triggered via comparison to the preselected curve, the sample temperature does not exactly follow that curve but rather will fluctuate between the curve and some maximum differential above or below it. This method is therefore one of trial and error to produce a curve providing a desired result for a particular sample of given size, geometry and material.

One interesting method of accomplishing rapid phase change of the biological material contemplates precompression of the material and exposure to low temperature. On decompression the material therefore solidifies much more rapidly than if it were exposed to the same temperature in a nonprecompressed state. However, the method deals only with the phase change stage of the freezing process, and control of temperature change rates, if any, would be reliant on accurate mechanical control of the application and release of pressure.

Accordingly, it is an object of this invention to preserve biological materials by freezing.

It is a further object of this invention to minimize the risk of supercooling the biological material prior to the initiation of phase change.

Another object of the invention is to minimize the risk of temperature shock to the biological material.

A correlated object of the invention is to permit preselection of cooling rates, duration of phase change, and storage temperature.

SUMMARY OF THE INVENTION

In accordance with the invention, a method and apparatus for freezing biological materials is provided by which the material is cooled to freezing temperature or a temperature minimally warmer than freezing temperature at a substantially linear rate of temperature change. The environment surrounding the material is then rapidly chilled to a preselected temperature substantially below freezing temperature of the material to initiate phase change of the material, and then warmed to freezing temperature or a temperature minimally cooler than the freezing temperature of the material at or before the completion of phase change. Finally, the material is cooled to a preselected end temperature at a substantially linear rate of temperature change.

BRIEF DESCRIPTION OF THE DRAWINGS

Other objects and advantages of the invention will become apparent upon reading the following detailed description and upon reference to the drawings in which:

FIG. 1 is a fragmentary perspective view of the freezing unit;

FIG. 2 is a perspective view of the process programmer recorder;

Figure 3:
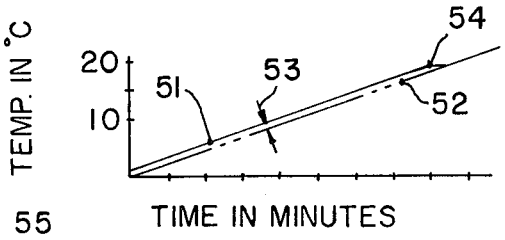
FIG. 3 is a graphical comparison of the freezing chamber and biological material temperatures during cooling of the material to freezing temperature.

While the invention will be described in connection with a preferred embodiment and procedure, it will be understood that it is not intended to limit the invention to that embodiment and procedure. On the contrary, it is intended to cover all alternatives, modifications and equivalents as may be included within the spirit and scope of the invention as defined by the appended claims.

DETAILED DESCRIPTION

Turning now to the drawings, the freezing unit 10 is illustrated in FIG. 1. The freezing unit 10 consists of a freezing chamber 11 disposed within a housing 12. A pair of air circulating system are provided which include air inlet passages 13 in the upper portions of opposite walls of the chamber 11, connected to air outlet passages 14 in the lower portions of those chamber walls by ducts 15. Each of the ducts 15 contains a blower 16 and a heater unit 17. Each of the air inlet passages 13 is aligned to direct the air flow past a coolant inlet passage 18 disposed in an adjacent chamber wall through which the coolant is introduced in a flow path transverse to the air flow. The coolant inlet passages 18, also preferably in opposite walls, are connected by transfer lines 19 to the coolant source as shown in FIG. 1. Flow of coolant through the transfer lines 19 is controlled by a solenoid valve 21. A sample of the biological material 22, disposed in a suitable vial 23, is supported in the freezing chamber 11 by a stand 24. The vial 23 is sealed by use of a cork 25. A pair of thermocouples 26 and 27 are also disposed within the freezing chamber 11. One thermocouple 26 extends within and senses the temperature of the chamber 11. The other thermocouple 27 extends into the sample of biological material 22, and is maintained at or approximate the geometric center of the sample by the cork 25, and senses the temperature of the sample. Access to the freezing chamber 11 is had via a hinged cover 28, and a gasket 29 of a suitable silicate assures satisfactory sealing of the chamber 11.

The chamber and sample temperature are controlled and recorded by a process programmer-recorder 30 consisting of two main sections, including the program controller 31 and the recorder controller 32.

In the preferred embodiment, the program controller 31 is itself composed of several interfaced sections. The power section 33 enables the operator to energize the main, blower and coolant power circuits. The blowers 16 are activated immediately upon energization of the blower power circuit, while the solenoid valve 21 is further controlled by additional control circuits as will be explained hereinafter.

The start temperature section 34 permits the operator to select the temperature at which the freezing cycle is to begin. Typically, a temperature of the freezing chamber 10 in the range of 0° to +25° C may be selected.

The liquid phase section 35 permits the operator to select the rate at which the freezing chamber 10 is cooled during the liquid phase, or the first stage of the freezing cycle. Typically, the freezing rate in this stage extends from a lower limit of 0.5° C per minute to an upper limit of 30° C per minute. Additionally, the operator may select the start phase change temperature which is the temperature at which the first stage of the freezing cycle ends and the second stage begins. This temperature is generally in the range of 0° C to −25° C, and is sensed by the sample thermocouple 27. The liquid phase section 35 is manually energized by the operator when the start temperature is reached.

The phase change section 36 permits the operator to select the coldest temperature to which the freezing chamber 10 wiill be cooled during phase change, usually in the range of −20° C to −100° C, and also the end phase change temperature of the chamber 11, usually in the range of 0° C to −40° C. This section controls the circuitry of both the solenoid valve 21 and the heaters 17.

The solid phase section 37 permits the operator to select the rate at which the freezing chamber 10 is cooled during the solidphase or third and final stage of the freezing cycle and to select the end or storage temperature of the freezing chamber 11 when the cycle will be completed. As in the liquid phase section, the freezing rate may be in the order of 0.5° C per minute to 30° C per minute. The end temperature of the chamber 11 may have a range of from −20° C to −100° C.

The recorder-controller 32 monitors the chamber and sample thermocouples 26 and 27 and permits the operator to independently select which of these temperatures is recorded or, in the alternative, to select an automatic switching circuit so that both may be recorded. For example, in the automatic circuit, sample temperature may be recorded for a period of 10 seconds and chamber temperature for a period of 2 seconds.

Since the composition of the biological material to be frozen in many cases is at least 70 percent water, the operation of the apparatus hereinbefore described can readily be explained by its application to freezing water.

The operator first sets the parameters of the freezing cycle on the program controller 31 of the process programmer-recorder 30. In the case of water being the substituted biological sample, it will be presumed that the desired starting and final temperature of the freezing chamber 11 are 20° C and −95° C respectively. The phase change temperature is, of course, 0° C. The operator therefore would set the start temperature control selector 38 of the start temperature section 34 at 20° C, the start phase change selector 39 of the liquid phase section 35 at or slightly above 0° C, the end phase change selector 40 of the phase change section 36 at approximately −5° C, and the end temperature selector 41 of the solid phase section 37 at −95° C.

In addition the operator also preselects the freezing rates in both the liquid and solid phases. In this instance, if the desired time of each of those stages is ten and twenty minutes respectively, the operator will set the liquid phase freezing rate selector 42 at 2° C/minute and the solid phase freezing rate selector 43 at 4.5° C/minute. Finally, the operator sets the temperature of the freezing chamber 11 during phase change.

Having preselected the parameters of the entire freezing cycle, the freezing chamber 11 is cooled to the start temperature control temperature. Energization of the main, blower and coolant power circuits operates the solenoid valve 21 to introduce coolant to the chamber 11 until the preselected temperature of 20° C is reached. The circuitry of the start temperature section 34 then automatically compares the preselected temperature to the actual chamber temperature as sensed by the chamber thermocouple 26, and energizes and deenergizes the solenoid valve 21 to maintain the preselected start temperature.

When the freezing chamber 11 has reached the start temperature, the operator places the vial 23 containing the prepared sample 22 in the chamber 11, inserts the sample thermocouple 27 into the geometric center of the sample 22, and seals the chamber 11.

Having accomplished these preparations, the first step of the freezing process, the cooling of the sample 22 to the phase change or freezing temperature, or a temperature minimally warmer than the freezing temperature, is initiated. The circuitry of the liquid phase section 35 is manually energized and solenoid valve 21 sporadically opened and closed thereby to linearly cool the chamber 11 at the preselected cooling rate set on the freezing rate selector 42. This cooling of the chamber 11 is controlled via the chamber thermocouple 26 and not the sample thermocouple 27. Consequently it is the temperature of the chamber 11 which is controlled during this stage of the cycle. However, the sample temperature will follow the chamber temperature at some relatively constant temperature difference. Referring to FIG. 3 the sample temperature 51 and chamber temperature 52 recorded by the recorder controller 32 during the first stage of the freezing process are illustrated. As shown, the sample temperature 51 follows the chamber temperature 52 at a difference 53 of approximately 2° C. For any given type or geometry of sample 22 the difference 53 will be greater as the freezing rate is increased. It can be seen that the temperature difference 53 is realized early in this stage, point 54, and therefore, although the rate is controlled in reference to the chamber temperature, the rate of change of sample temperature is itself substantially linear.

The temperature curves 51 and 52 clearly show that, due to the lag in sample temperature, the sample 22 does not reach the start phase change temperature of 0° C, shown at point 55, until the chamber temperature has dropped below 0° C by approximately the differential 53. If the phase change cycle were initiated via chamber thermocouple 26, it would be necessary to know in advance exactly what the differential 53 would be and to delay operation of the phase change circuitry in order to compensate. However, since the sample thermocouple 27 initiates this second stage, neither the chamber temperature nor the differential 53 are significant. Phase change will be initiated at the optimum preselected sample temperature.

Figure 4:
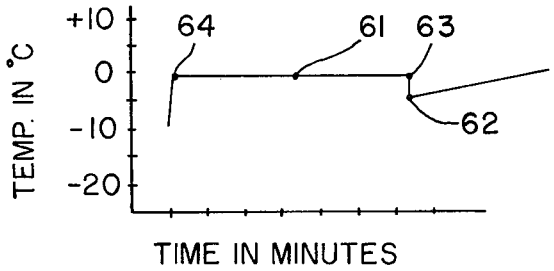
FIG. 4 is a typical graphical illustration of the temperature of the biological material during the phase change cycle of the freezing apparatus currently in use.
Figure 5:
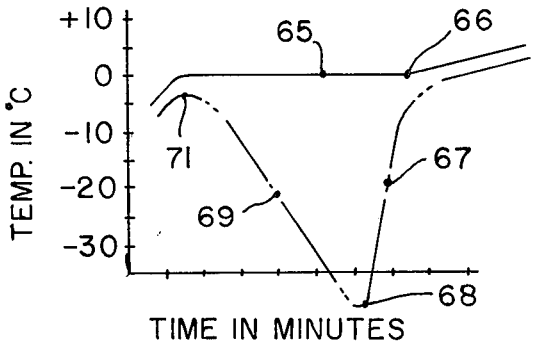
FIG. 5 is a graphical comparison of the freezing chamber and biological material temperatures during the phase change cycle of the present invention.

Turning now to FIGS. 4 and 5, the operation of the system during phase change can be explained. Curve 61 is representative of a typical phase change cycle resulting from apparatus commonly in use today. Before solidification or removal of the heat of fusion begins, the sample temperature actually falls below the freezing temperature of the sample, as shown at 62. The sample remains in the sub-cooled state until removal of the heat of fusion begins, at which time the sample returns to freezing temperature, as shown at 63. The sample then remains at freezing temperature until the heat of fusion has been removed, at which time the sample temperature drops rapidly, as shown at 64. As was previously stated, subcooling and rapid temperature change are harmful to the biological material. These problems are eliminated by the present system as is shown by curve 65, which represents the temperature of the biological material during the phase change cycle. The smooth transition at point 66, which corresponds to point 55 of FIG. 3, is accomplished by the second step of the process in which the environment surrounding the biological material is rapidly chilled to a preselected temperature substantially colder than the freezing temperature of the material. That is, when the material reaches the freezing temperature or a temperature minimally warmer than freezing at point 66, as set on the start phase change selector 39, a comparator circuit of the liquid phase section 35 controlled by sample thermocouple 27 fully opens the solenoid valve 21, admitting a continuous burst of refrigerant to the chamber 11. This burst of refrigerant rapidly chills the environment, as shown at 67, and causes phase change to begin before the biological material can fall below freezing temperature.

As the heat of fusion of the biological material is being removed and phase change continues, the next step in the freezing process, warming of the chamber 11 to or minimally below the freezing temperature of the material, is initiated. When the chamber temperature has plunged to the temperature set on the temperature drop selector 44 shown at point 68 and sensed by the chamber thermocouple 26, the circuitry of the phase change section 36 closes the solenoid valve 21 and energizes the heater units 17. The environment surrounding the biological material is then warmed, as shown on the curve at 69, until the chamber temperature reaches or is minimally below the freezing temperature of the material, as set on the end phase change selector 30 and shown on the curve at 71. At this point, sensed by the chamber thermocouple 26, phase change is completed and the circuitry of the phase change section 36 deenergizes the heater units 107. Since the chamber temperature is relatively equal to the freezing temperature of the biological material, the sudden drop of temperature in the material shown at point 64 of FIG. 4 is avoided, and a smooth transition into solid phase freezing as shown at point 71 of FIG. 5 is accomplished.

Figure 6:
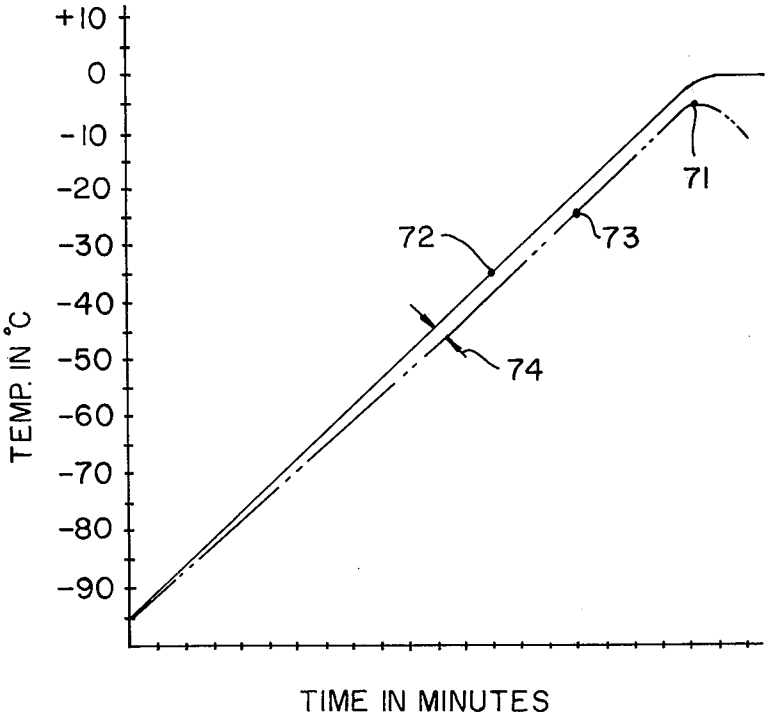
FIG. 6 is a graphical comparison of the freezing chamber and biological material temperatures during cooling of the material to end temperature.

The solid phase section 37 then controls the final step of the process, the cooling of the biological material to approximately the storage temperature set on the end temperature selector 41. This step of the process is similar to the first, in which the chamber thermocouple 26 senses the chamber temperature and, via the circuitry of the solid phase section 37, sporadically opens and closes the solenoid valve 21 to drive the chamber temperature to the selected end temperature at a substantially linear rate of change set on the freezing rate selector 43. As shown in FIG. 6, the temperature 72 of the biological material follows the chamber temperature 73 at a relatively constant temperature difference 74 to approximately the desired end temperature.

While the entire process is programmed for automatic operation from the point of reaching the starting temperature to the point of reaching the end temperature, manual overrides for operation of the blowers 16, heater units 17 and solenoid 21 are also provided. Thus, the operator is able to individually control the process as the chamber and sample temperatures indicated on the recorder 32 may dictate. For example, it is not absolutely necessary to approach freezing temperature in the liquid phase at a linear rate provided the material does not fall below freezing temperature. Furthermore, once the preselected end temperature is reached, it may be desireable to continue to a colder storage temperature at a different rate of temperature change.

Thus it is apparent that there has been provided, in accordance with the invention, a process and apparatus that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A process for preserving biological materials by freezing comprising the steps of:

cooling the biological material to a temperature equal to or minimally warmer than the freezing temperature of the material;

chilling the environment surrounding the biological material rapidly to a preselected temperature substantially colder than the freezing temperature of the material to initiate phase change of the material;

warming the environment surrounding the biological material from said preselected temperature to a temperature equal to or minimally cooler than the freezing temperature of the material during removal of the heat of fusion of the material; and cooling the environment surrounding the biological material at a substantially linear preselected rate of temperature change to a preselected end temperature.

2. The process according to claim 1, the step of cooling the biological material comprising the substeps of:

introducing a refrigerant to the environment surrounding the biological material in intermittent bursts;

sensing the temperature of the biological material; and terminating introduction of the refrigerant when the temperature of the biological material is approximately but not less than the freezing temperature of the material.

3. The process according to claim 1, the step of chilling the environment comprising the substeps of:

triggering a continuous flow of refrigerant to the environment surrounding the biological material;

sensing the temperature of the environment; and terminating the flow of refrigerant when the environment reaches the preselected temperature.

4. The process according to claim 1, the step of warming the environment comprising the substeps of:

introducing a flow of warm air to the environment surrounding the biological material;

sensing the temperature of the environment; and terminating the flow of warm air when the environment reaches a temperature approximately but not higher than the freezing temperature of the biological material.

5. The process according to claim 1, the step of cooling the environment comprising the substeps of:

introducing a refrigerant to the environment in intermittent bursts; and sensing the temperature of the environment.

6. The process according to claim 1 further comprising the step of intermittantly recording the temperature of the biological material and the temperature of the surrounding environment during the process.

7. A process for preserving biological materials by freezing comprising the steps of:

cooling the biological material at a substantially linear preselected rate of temperature change to approximately but not less than the freezing temperature of the material;

chilling the environment surrounding the biological material rapidly to a preselected temperature in the range of −20° C to −100° C;

warming the environment to a temperature approximately but not more than the freezing temperature of the biological material; and cooling the environment at a preselected substantially linear rate of temperature change to a preselected temperature in the range of −20° C to −100° C.

8. The process according to claim 7 wherein the rate of cooling the biological material and the rate of cooling the environment are independently selectively in the range of 0.5° C per minute to 30° C per minute.

9. A process for preserving biological materials by freezing comprising the steps of:

placing the biological material in a cooling chamber;

introducing a refrigerant to the cooling chamber in intermittant bursts to lower the temperature of the biological material;

sensing the temperature of the biological material;

triggering a continuous burst of refrigerant into the cooling chamber when the biological material is at or minimally warmer than freezing temperature;

sensing the temperature of the chamber;

terminating the flow of refrigerant into the chamber when the chamber temperature reaches a preselected temperature substantially lower than the freezing temperature of the biological material and prior to completion of removal of the heat of fusion of the biological material;

introducing a flow of warm air to the chamber when flow of refrigerant is terminated;

terminating the flow of warm air when the chamber temperature is at or minimally lower than the freezing temperature of the biological material; and reintroducing intermittant bursts of refrigerant to the cooling chamber to substantially linearly lower the temperature of the biological material to a preselected end temperature.

10. Apparatus for preserving biological materials by freezing comprising in combination:

a cooling chamber and a refrigerant source interconnected by a transfer line having a valve disposed therein;

means for continuously circulating the air in said chamber;

a first thermocouple for sensing the temperature of a sample of the biological material;

a second thermocouple for sensing the temperature of the cooling chamber;

means for warming the air in said chamber; and circuit means for receiving electrical signals from said first and second thermocouples and for transmitting signals to said valve and to said warming means, said circuit means being operable to sequentially:

i. intermittantly open and close said valve to cool the biological material in the liquid phase to a temperature approximately but not warmer than the freezing temperature of the material;

ii. open said valve to rapidly chill said chamber to a preselected temperature substantially colder than the freezing temperature of the material;

iii. close said valve and energize said warming means;

iv. deenergize said warming means when said chamber returns to approximately but not higher than the freezing temperature of the material; and v. intermittantly open and close said valve to cool the biological material in the solid phase at a substantially linear rate of temperature change to an end temperature.

11. The apparatus defined in claim 10 further comprising means for securing said first thermocouple at approximately the geometric center of the sample of biological material.

12. The apparatus defined in claim 10 wherein said circulating means comprises an air inlet passage to and an air outlet passage from said chamber, said passages being interconnected by a duct to form a continuous path of air flow, said duct having a blower means disposed therein for causing a flow of air along said path.

13. The apparatus defined in claim 12, said transfer line being connected to said chamber via a refrigerant inlet passage in said chamber, said refrigerant inlet passage being aligned to introduce refrigerant into said chamber along a path transverse to the path of air flow through said air inlet passage.

14. The apparatus defined in claim 13 further comprising means disposed in said chamber for interrupting a direct flow of refrigerant or air from said passages to the biological material or the sample thereof.

15. The apparatus defined in claim 10, said circuit means including a plurality of independently variable means operable to select respectively the cooling rate in the liquid phase, the liquid phase final temperature, the preselected chill temperature, the deenergization of warming means temperature, the end temperature and the cooling rate in the solid phase.

16. The apparatus defined in claim 15 wherein said variable means have respective ranges of 0.5° C per minute to 30° C per minute, 0° C to −25° C, −20° C to −100° C, 0° C to −40° C and 0.5° C per minute to 30° C per minute.

* * * * *